US007731023B1

(12) United States Patent
Lesch

(10) Patent No.: US 7,731,023 B1
(45) Date of Patent: Jun. 8, 2010

(54) PORTABLE STORAGE AND DISPLAY CASE FOR MILITARY DECORATIONS AND JEWELRY

(76) Inventor: John R. Lesch, 96062 Sweetbriar La., Yulee, FL (US) 32097

( * ) Notice: Subject to any disclaimer, the term of this patent is extended or adjusted under 35 U.S.C. 154(b) by 237 days.

(21) Appl. No.: 11/850,217

(22) Filed: Sep. 5, 2007

Related U.S. Application Data

(60) Provisional application No. 60/884,480, filed on Jan. 11, 2007.

(51) Int. Cl.
*A45C 11/04* (2006.01)
*A45C 13/18* (2006.01)
*B65D 73/00* (2006.01)
*A47G 1/12* (2006.01)

(52) U.S. Cl. ..... 206/6.1; 40/1.5; 190/101; 206/472

(58) Field of Classification Search ..... 206/1.5, 206/6.1, 472–475, 566; 190/101; 40/1.5; 383/40
See application file for complete search history.

(56) References Cited

U.S. PATENT DOCUMENTS 3,134,484 A * 5/1964 Cox et al. ..... 206/6.1
4,287,986 A * 9/1981 Beck ..... 206/472
4,720,012 A * 1/1988 Dufour ..... 206/472
4,792,026 A * 12/1988 Dimmick et al. ..... 190/101
4,848,562 A * 7/1989 Liu ..... 206/6.1
5,261,529 A 11/1993 Holland
5,353,921 A 10/1994 Tyra
5,551,772 A 9/1996 Keffer
5,817,379 A * 10/1998 Rich et al. ..... 383/40
5,890,587 A * 4/1999 Roegner ..... 206/6.1
6,739,451 B2 * 5/2004 Mateus et al. ..... 211/41.12
2007/0246389 A1 * 10/2007 Marcello ..... 206/472

* cited by examiner

*Primary Examiner*—Byron P Gehman
(74) *Attorney, Agent, or Firm*—Allen, Dyer, Doppelt, Milbrath & Gilchrist, P.A.

(57) ABSTRACT

A portable storage and display case for valuable items such as military decorations and jewelry having a rigid front member, and a rigid rear member, a spine joining the front member with the rear member, and an interior surface having first and second interior pockets, capable of holding an insert capable of slidably connecting into the first and second interior pockets. A portfolio further comprising at least one sheet of a recoverable plastic portfolio sheet capable of receiving pins and folded into halves. A padded protector panel having at least one pocket therein, and disposed between the two halves of the recoverable plastic portfolio sheet so that the two halves do not come into contact with one another.

10 Claims, 3 Drawing Sheets

PORTABLE STORAGE AND DISPLAY CASE FOR MILITARY DECORATIONS AND JEWELRY

CROSS-REFERENCE TO RELATED APPLICATIONS

This application claims priority to provisional application Ser. No. 60/884,480, filed Jan. 11, 2007, entitled "Portable Storage Case for Military Decorations, Jewelry and the Like."

FIELD OF THE INVENTION

The present invention relates to the field of portable storage cases and, more specifically, to a portable storage case for military decorations, medals awards and jewelry.

BACKGROUND OF THE INVENTION

Military and uniformed services personnel often must take their uniforms with them when traveling. These persons are often confronted with the problem of how to best transport their insignia pins and awards without losing them and without damaging them. If these pins are left attached to a uniform, they can catch the fabric during travel as a uniform is redistributed in a suitcase when being carried and during baggage handling. This can cause the pins to catch the fabric and snag the uniform material. If the pins are removed from the uniform, there is no suitable way of carrying them. Service personnel have relied on such methods as wrapping the metals in tissue paper and carrying them in plastic containers or plastic bags. This method is time consuming and subject to loss.

SUMMARY OF THE INVENTION

In view of the foregoing background, it is therefore an object of the present invention to provide a novel way of carrying military insignia and decorations for traveling service personnel that will prevent the decorations from becoming marred or otherwise damaged. This case has the added advantage of being able to stand upright so that pins and decorations may be displayed on a desk or counter, when the owner is not traveling. In addition, the present carrying and display case provides a means of travel storage for civilians, who may use such a storage case for jewelry, tie tacks, or pins when traveling or simply as a convenient way to store these items.

BRIEF DESCRIPTION OF THE DRAWINGS

For a fuller understanding of the invention, reference is made to the following detailed description, taken in connection with the accompanying drawings illustrating various embodiments of the present invention, in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternate embodiments.

Figure 1:
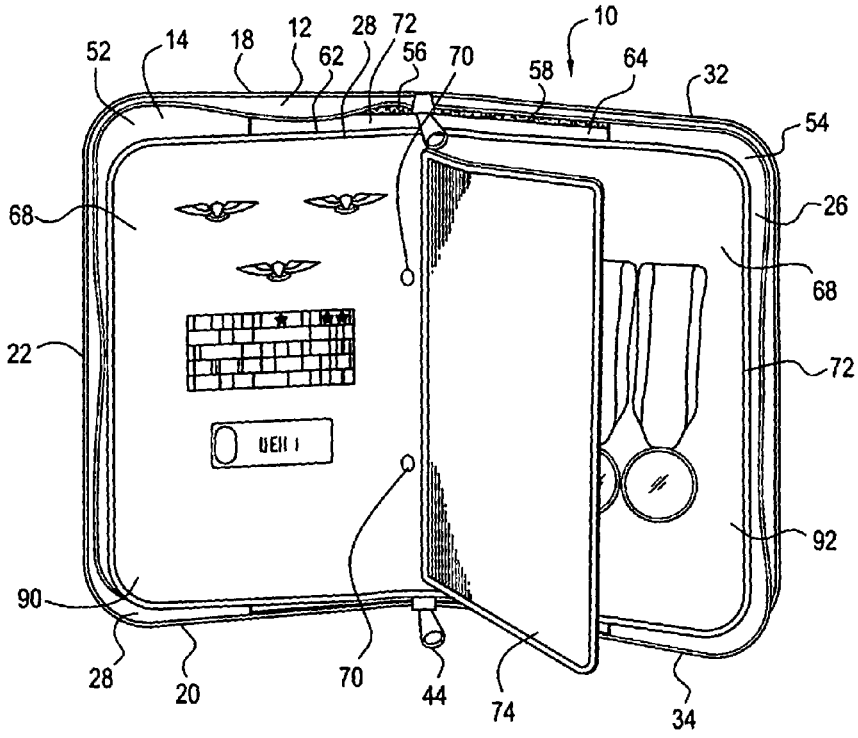
FIG. 1 is a view of an open portable storage and display case showing the major components such as the portfolio support panels, portfolio sheets, and padded separator as they would be used to display military decorations according to an embodiment of the present invention.

Referring initially to FIG. 1, a portable storage and display case 10 for valuable items, such as military decorations and jewelry, includes a rigid front member 12 having an inside surface 14 opposed to an outside surface 16. The rigid front member 12 has a top edge 18 opposed to a bottom edge 20, and opposing front 22 and rear edges 24. In addition, a rigid rear member 26 has an inside surface 28 opposed to an outside surface 30. The rigid rear member 26 has a top edge 32 opposed to a bottom edge 34, and opposing front 36 and rear (not shown) edges. A spine 40 joins the front member 12 with the rear member 26 along their respective rear edges, creating a unitary exterior cover 42. An optional fastener 44, such as a zipper or Velcro®, surrounding the front and rear members 12, 26 can be used for closing the case. In embodiments where a two-way zipper is used, a lock 45 may also be advantageously used to protect the contents inside. Those skilled in the art will also recognize that where the rigid members 12, 26 are made of composite or metal, other closure means, such as a key lock and metal rim, a hasp lock or even a combination lock, for example, may be preferably used.

Figure 2:
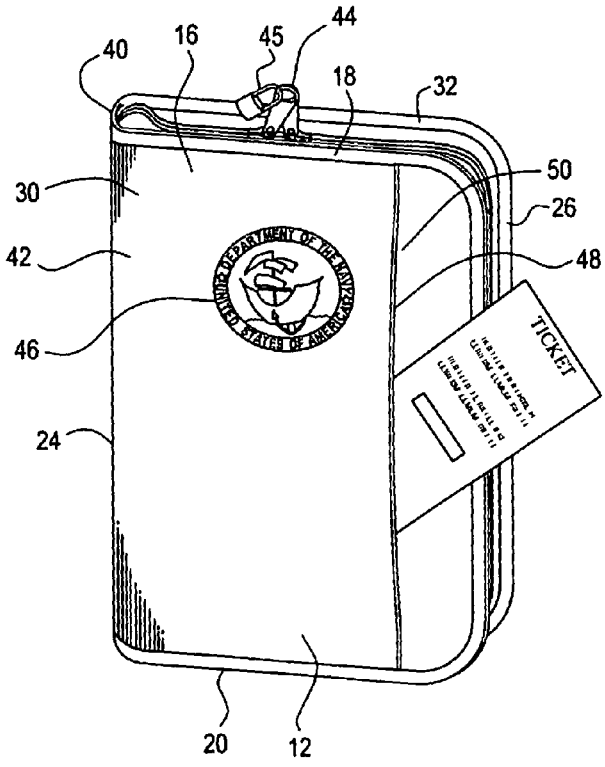
FIG. 2 is a view of a closed portable storage case showing indicia of ownership and an exterior pocket for carrying papers as it would appear in use according to an embodiment of the present invention.

Referring to FIG. 2, the cover 42 may be made of any material suitable for the application including cloth, GORTEX®, plastics, vinyl, leather and metals, for example. The exterior cover 42 surface is preferably suitable for carrying indicia 46 of ownership. Such indicia 46 may include military service insignia, commercial logos and trademarks, herald crests, monograms, and other personalized identifying indicia. The indicia 46 may be added to the cover using embroidery, appliqués, patches, all forms of printing techniques, pad prints, for example. A pocket 48 may be optionally included on the exterior surface of either the front member 12, the rear member 26, or both to be used for holding tickets, travel orders, or other important papers. In addition, a fastener 50, such as a zipper or Velcro, for example, may be optionally included at the opening of the pocket 48, to secure and to prevent the loss of the contents.

Figure 3:
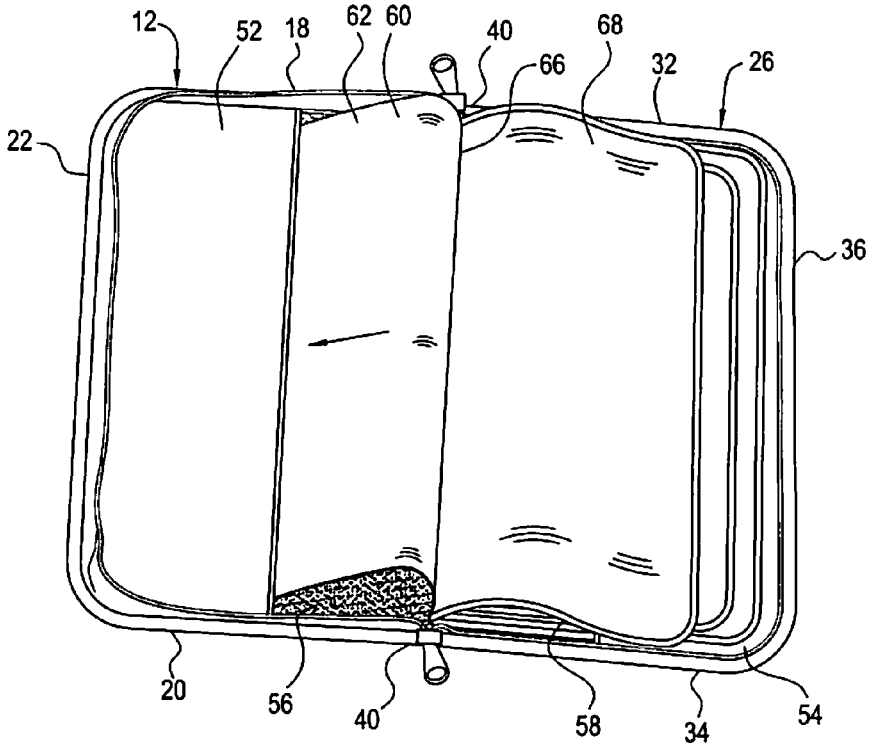
FIG. 3 is a open view of the portable storage case showing the front support panel slidably engaging the front retention pocket.

Referring to FIG. 3, a pair of retention pockets 52, 54 is located on the inside surfaces 56, 58 of the front and rear members 12, 26, respectively. Each pocket 52, 54 extends longitudinally between the top edge 18, 32 and the bottom edge 20, 34 of its respective member 12, 26; and laterally between the front edge 22, 36 and the spine 40 along the inside surface 56, 58. The retention pockets 52, 54 may be made from the same material as the front and rear members 12, 26, or they may be made of a different material so long as the material of the pocket is rigid enough to contain and support a portfolio support 60, therein.

A portfolio support 60 formed of a sheet having a first panel 62 and a second panel 64, the first panel capable of slidably engaging the retention pocket 52 in the front member 12. The second panel 64 should also be capable of slidably engaging the retention pocket 54 in the rear member 26. A portion 66 of the portfolio support 60 between the two panels 62, 64 is placed in abutment with the spine 40.

Attached to the portfolio support 60, is a recoverable plastic portfolio sheet 68. The portfolio sheet 68 extends laterally across the portfolio support 60 and is attached thereto by stitching or by a plurality of connectors 70, as shown as in FIG. 1 as two covered brads, for example. Those skilled in the art will recognize that the connectors 70 of the plurality may be of other types including bolts, bonnets, brads, grommets, pins, rivets, pop rivets, screws, solder, stitching, and welds, for example.

Figure 4:
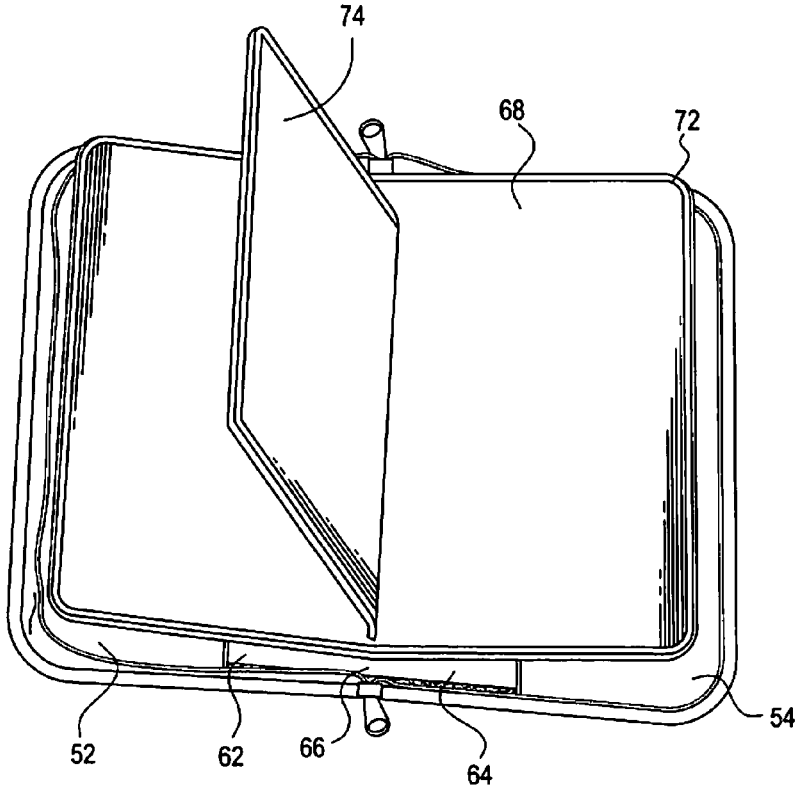
FIG. 4 is an open view of the portable storage case showing a separator pad disposed between the two halves of a portfolio sheet.

Referring to FIGS. 1 and 4, the portfolio sheet 68 is adapted to receive and hold military decorations and jewelry and the like by permitting a pin or tack that is part of the item to be displayed to pierce the sheet and to be held in place with a corresponding clasp, pin or earring back or tie tack. An optional soft outer edging 72, such as ribbon or piping, for example, may preferably be attached to the outer rim of the portfolio sheet 68, to prevent the portfolio sheet from tearing and to improve its overall appearance.

Figure 5:
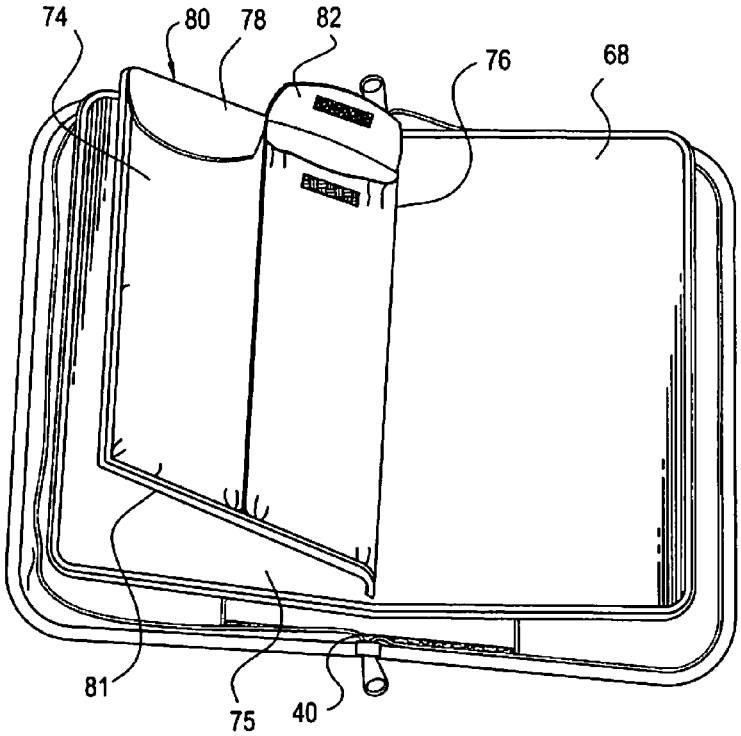
FIG. 5 is an open view of the portable storage case showing a separator pad disposed between the two halves of a portfolio sheet the separator pad including two horizontal pockets for storing epaulets.

A padded separator 74 is fitted to an inside surface 75 of the portfolio sheet 68 along an attachment line 76 generally parallel with the spine 40. In a preferred embodiment, the padded separator 74 may be a single sheet of a soft padded fabric that simply prevents the contents displayed on one half the portfolio sheet 68 from becoming scratched or otherwise damaged by rubbing against the contents on the facing half of the portfolio sheet. Referring to FIG. 5, the padded separator 74 may optionally include a pair of pockets 78 that run from top edge 80 of the padded separator to a bottom edge 81. An optional fold-over flap 82 near the top edge 80 of these pockets 78 can be used to close them and prevent their contents from shifting, and potentially becoming marred during use.

Figure 6:
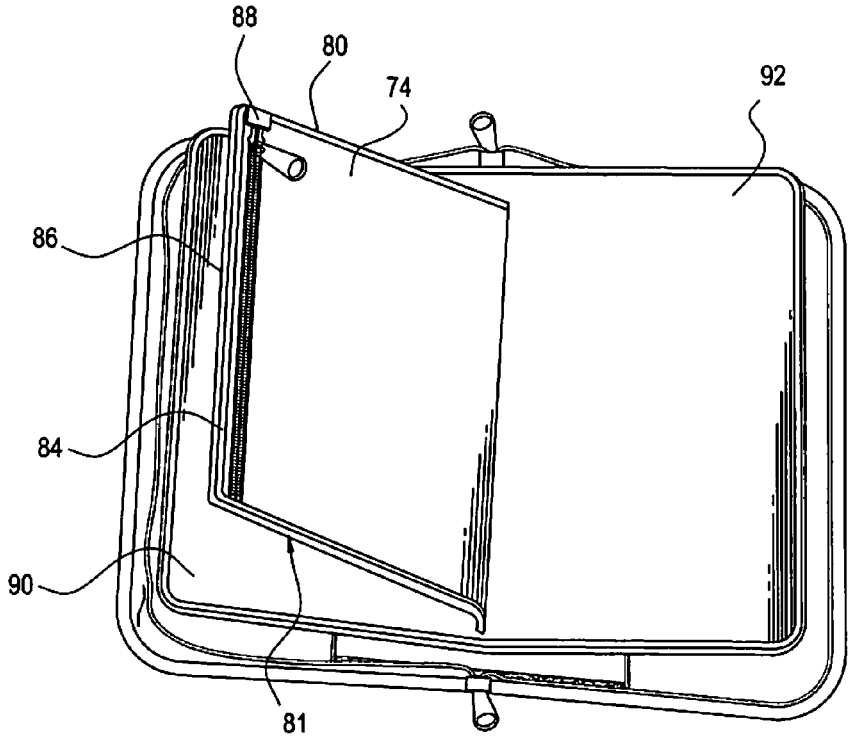
FIG. 6 is an open view of the portable storage case showing a separator pad disposed between the two halves of a portfolio sheet the separator pad including a central pocket.

Referring to FIG. 6, still another configuration of the padded separator 74 may include a pocket opening 84 along a top edge 86 of the padded separator. This large pocket 84 is ideally suited for larger pieces of jewelry, such as necklaces or bracelets, or for uniform braids, for example. A closing mechanism 88, such as a zipper or Velcro™, for example, can protect the contents.

A method of carrying military decorations when traveling using this novel portable storage and display case is also contemplated. Upon obtaining portable storage and display case, the traveler arranges the decorations in the order they are worn on the left side of the uniform on a front half 90 of a portfolio sheet 68 of the portable storage and display case 10. The traveler then secures the decorations to the left sheet of a portfolio sheet 68 as arranged.

Then the traveler arranges the decorations in the order they are worn on the right side of the uniform on a rear half 92 of the portfolio sheet 68 located on the right side of the portable storage and display case 10. The traveler then secures the decorations to the right side of a portfolio sheet as arranged. The traveler may then place epaulets in each of the optional epaulet pockets 78, if he is of a rank to have them. The traveler then closes the portable storage and display case 10, and zips it shut, and locks it.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A portable storage and display case for valuable items comprising:

a rigid front member having opposing inside and outside surfaces, opposing top and bottom edges and a front edge and a rear edge opposing one another;

a rigid rear member having opposing inside and outside surfaces, opposing top and bottom edges and a front edge and a rear edge opposing one another;

a spine joining the front member with the rear member along the respective edges thereof;

a pair of retention pockets, each pocket extending along the inside surface of a corresponding one of the front and rear members longitudinally between the top and bottom edges, and laterally between the front and rear edges along the inside surface between the front edge and the spine;

a portfolio support formed of a sheet having a first panel and a second panel, the first panel slidably engaged in the retention pocket of the front member and the second panel slidably engaged in the retention pocket of the rear member, with a portion of the portfolio support between the two panels in abutment with the spine;

a recoverable plastic portfolio sheet fixed and extending laterally across the portfolio support and adapted to receive and hold military decorations and jewelry thereon;

a padded separator fitted to an inside surface of the portfolio sheet along a line generally parallel with the spine; and a fastener for closing the front and rear members.

2. The portable storage and display case of claim 1 wherein the outside surface of the rigid front member has indicia of ownership.

3. The portable storage and display case of claim 2 wherein said exterior pocket has a closure.

4. The portable storage and display case of claim 1 wherein the outside surface of the rigid front member includes an exterior pocket.

5. The portable storage and display case of claim 1 wherein said recoverable plastic portfolio sheet is capable of receiving pins without deforming.

6. The portable storage and display case of claim 5 wherein said at least one pocket includes a pair of pockets capable of carrying military epaulets.

7. The portable storage and display case of claim 1 wherein said padded separator having at least one pocket.

8. The portable storage and display case of claim 1 wherein said fastener has a combination lock.

9. The portable storage and display case recited in claim 1 wherein the fastener comprises a zipper for joining outer edges of the front and rear members together.

10. The portable storage and display case recited in claim 1 wherein the front and rear members are sufficiently rigid so as to permit the case to be displayed in an open position with the spine extending generally vertically.

* * * * *